United States Patent [19]

Hatfield

[11] Patent Number: 4,578,310

[45] Date of Patent: Mar. 25, 1986

[54] METHOD OF PRODUCING ADHERENT METALLIC FILM

[75] Inventor: Raymond W. Hatfield, Warren, Mich.

[73] Assignee: Michael Landey, Grosse Pointe Shores, Mich.

[21] Appl. No.: 757,345

[22] Filed: Jul. 22, 1985

[51] Int. Cl.[4] ..... B32B 27/00; B32B 9/04; B32B 15/08; B05D 1/00

[52] U.S. Cl. ..... 428/334; 427/34; 427/258; 427/404; 427/423; 428/335; 428/414; 428/416; 428/425.8; 428/448; 428/450; 428/451; 428/461; 174/35 MS

[58] Field of Search ..... 427/404, 34, 105, 123, 427/258, 423; 428/334, 335, 336, 327, 461, 463, 423.1, 425.5, 425.8, 416, 414, 413, 448, 450, 451

[56] References Cited

U.S. PATENT DOCUMENTS

| | | | |
|---|---|---|---|
| 4,089,993 | 5/1978 | Shirahata et al. | 427/129 |
| 4,104,432 | 8/1978 | Manabe et al. | 428/216 |
| 4,148,945 | 4/1979 | Bangs et al. | 427/304 |
| 4,197,337 | 4/1980 | Di Biasi et al. | 427/270 |
| 4,216,246 | 8/1980 | Iwasaki et al. | 427/43.1 |
| 4,217,016 | 7/1980 | Manabe et al. | 427/54.1 |
| 4,315,970 | 2/1982 | McGee | 428/412 |
| 4,439,768 | 3/1984 | Ebneth et al. | 343/18 B |
| 4,487,815 | 12/1984 | Dorsett et al. | 428/219 |
| 4,522,850 | 6/1985 | Leech | 427/304 |
| 4,544,571 | 10/1985 | Miller | 427/40 |

*Primary Examiner*—Thurman K. Page
*Attorney, Agent, or Firm*—Brooks & Kushman

[57] ABSTRACT

A method of producing an adherent metallic film for a thermoplastic or thermoset polymeric substrate to provide radio frequency shielding of electromagnetic interference. The polymeric substrate is prepared for application of the metallic film by application of a primer. The primer is an organic-based coating having a dispersion of silica gel to enhance the microscopic surface area and improve adhesion. The silica gel has an average particle size of approximately 20 microns and forms 2–10% of the mixture by weight. A catalyst may be added to the primer to promote curing. The metallic film is preferably zinc and may be applied by either flame or arc spraying technique, or electroless plating of the primed surface.

22 Claims, 2 Drawing Figures

METHOD OF PRODUCING ADHERENT METALLIC FILM

TECHNICAL FIELD

This invention relates to a method of producing adherent metallic film for application to non-metallic substrates for electromagnetic interference shielding.

BACKGROUND ART

Electromagnetic interference ("EMI") is the electromagnetic noise which radiates from operation of electrical and electronic devices. The emanation of such noise can radiate into space, or along electrical power lines, or both. The portion of the EMI in the radio frequency ("RF") range may cause harmful interference with radio communications.

A computing device can represent a significant source of EMI in a communications environment. The modern design trend of computing devices is with plastic housings which, unless shielded, are relatively transmissive of EMI. In order to shield the exterior environment of such a computing device, it is necessary to apply a metallic coating to the inner surfaces of the plastic housing. The Federal Communications Commission has regulated the emission of RF energy from computing devices in 47 C.F.R. § 15.801 et seq. The manufacturers of such computing devices are now generally required to verify compliance of the devices with the field strength limitations set forth in the regulations.

One conventional method of coating plastic electronic cabinets with EMI shielding has included the steps of sand or grit blasting the cabinet interior with abrasive material, cleaning the cabinet to remove abrasives and other impurities, and spraying metal film (usually zinc) by an arc or plasma spraying process. However, if any of the surface area of the cabinet interior is missed by the sandblasting operation, the metal adhesion is very poor since it relies on the abraded surface for adhesion.

Another conventional method is to subject the cabinet to chemical etching, such as by a chromic acid rinse. This method generally results in all surfaces of the cabinet, interior and exterior, being etched. Subsequently, a metallic coating can then be applied to the interior surfaces for example by an electroless metallic coating process.

The prior art methods hold certain disadvantages reflected in relatively slow production rates, need for special equipment, environmental control requirements for containing abrasive grit or disposing of hazardous chemical wastes resulting from chemical etching and the like. Of particular concern is the adhesion of the metallic film to the plastic cabinet. Any interruption in surface preparation can result in poor adhesion and undesired emission of EMI. In fact, adhesion requirements have now been made the subject of equipment manufacturer specifications, and an exemplary specification requires adhesion of the metallic film to withstand a pull force of approximately 70 oz/in.

DISCLOSURE OF THE INVENTION

The present invention uses a primer to prepare the surface of a non-metallic article, such as the plastic housing of a computing device, to accept a metallic film for EMI shielding. The primer yields enhanced microscopic surface area to improve adhesion of the metallic film.

In the process of the invention, the primer is formulated initially of silica gel dispersed in an organic-based coating. The dispersion is preferably achieved by air agitation of the mixture. A catalyst is then added to the mixture just prior to application to promote curing of the coating, i.e. crosslinking of the polymers in the coating.

The primer thus formulated is sprayed onto the surface of the substrate to a thickness of 1–5 mils. The primer is allowed to cure either by air drying at ambient temperature for approximately ½ hour, or by subjecting the article to temperatures in the range of 120°–160° F. for 15–20 minutes.

The EMI shielding can then be applied by spraying metallic film onto the primed surface of the substrates or by electroless metal plating process which would chemically deposit metal onto the primed surface.

The process yields an article exhibiting consistently strong adhesion of the metallic film. Further, the process realizes production advantages reflected in lower labor cost, lower scrap rates and consistent quality of shielded articles relative to prior art methods.

Other advantages and features of the present invention will be made apparent in reference to the following detailed description of the invention.

BEST MODE FOR CARRYING OUT THE INVENTION

Figure 1:
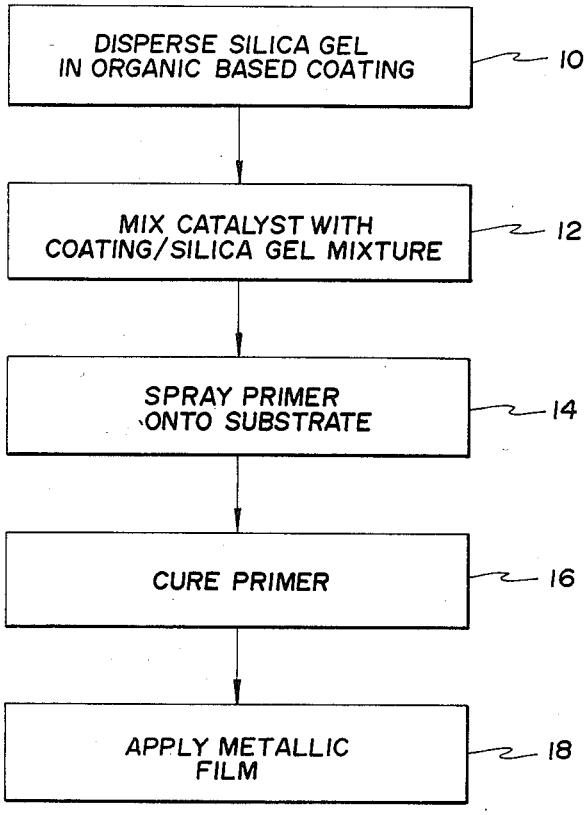
FIG. 1 is a flow chart depicting process steps related to the method of the present invention.

With reference to FIG. 1, the method of the present invention is illustrated schematically in the form of process steps enumerated 10–18. For purposes of the following description it is assumed that the substrate to receive the metallic film has been thoroughly cleaned and that all evidence of oil, grease and mold release agent have been removed.

In step 10, an organic-based coating is mixed with silica gel in an initial formulation of the primer. The coating may be based upon such resins as vinyls, acrylics, urethanes (preferred), epoxy, nitrocellulose, modified alkyds or various combinations of these resins. The silica gel is a colloidal, highly absorbent silica having an average particle size of approximately 20 microns, and comprises 2–10% of the mixture by weight. A commercially suitable silica gel has the brand designation Syloid 620 and is manufactured by the Davison Chemical Division, Industrial Chemicals Department of the W. R. Grace Company of Baltimore, Md. The silica gel is preferably dispersed uniformly within the organic-based coating by air agitation of the mixture.

In step 12, a catalyst, e.g. an isocyanate, may be added just prior to application of the primer to promote ambient temperature curing. The catalyst co-reacts with the mixture to promote hardening and adhesion of the primer film on the substrate.

In step 14, the primer mixture is sprayed onto the substrate to a thickness of between 1–5 mils. The presence of the silica gel tends to give the surface of a suede-like texture with a microscopic surface area greater than that obtained by grit blasting or chemical etching.

In step 16, the primer is allowed to cure either by air drying at ambient temperature for approximately ½ hour, or by subjecting the article to temperatures in the range of 120°–160° F. for 15–20 minutes.

In step 18, a metallic film is applied to the cured primer. One standard type of metallic film is a wire metallized zinc coating. This may be applied by an arc spraying process in which a voltage is applied across two continuously fed zinc wires which arc and melt. Alternatively, the zinc wires may be drawn through an oxy-acetylene spray gun where the wire is continuously melted by the flame. In either case, the molten metal is atomized by a compressed air blast which carries molten zinc particles to the primed surface. The individual particles impact on one another and interlock to form a mechanically bonded, electrically conductive metallic film to shield EMI. A zinc coating of between 3–10 mils is normally the effective range of film thickness for shielding of EMI.

Another standard type of metallic film can be deposited by conventional electroless plating techniques. Preferably, the surface is electroless plated by tin-palladium transfer techniques in which the surface is sensitized, activated or catalyzed, and then contacted with a metallic salt solution to deposit elemental metal by chemical reduction.

In carrying out this type of process surface is sensitized by immersion in an acid bath of stannous chloride, stannous fluoborate or stannous sulfate and preferably stannous chloride. The sensitized surface is then washed or rinsed in tap water to remove excess stannous ions and to prevent contamination of the activator. The sensitized surface is activated or catalyzed by immersion in an acid bath of silver nitrate or preferably palladium chloride. The activated surface is then washed or rinsed to remove excess catalyst and to prevent contamination of the electroless plating bath.

The catalyzed surface is electroless plated by immersion in a bath of a cobalt or preferably nickel or copper salt solution. By chemical reduction elemental metal from the bath forms a complex bond through the tin and palladium to the treated resin surface.

The preferred compositions and operating conditions of the baths for electroless plating are set forth in the following Table.

TABLE

| Bath | Constituents | Composition | Immersion Time in Minutes | Temp. in F. |
|---|---|---|---|---|
| Sensitizer | Catalyst 9F Shipley Company, Inc. | 0.12 gms./liter Pd $Cl_2$ 8.7 gms./liter Sn Cl | 5–7 | 75 |
| Activator | Accelerator PA-492 Ethone, Inc. | 8%/vol. | 1–2 | 120 |
| Electroless Copper | Udique 820 Udylite Corp. | 820A 1.33% 820B 8.0% 820E .05% | 5–10 | 140 |
| Electroless Nickel | Borg Warner N-35 | N-35-1 10% N-35-2 8% N-35-3 2.5% | 6 | 80 |

Figure 2:
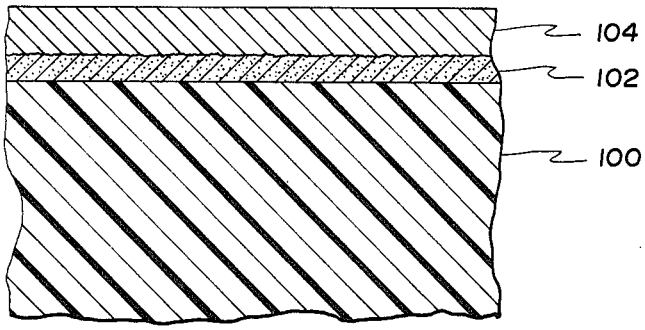
FIG. 2 is a representative cross-section of a shielded plastic substrate made in accordance with the present invention.

FIG. 2 is a cross-sectional view of a representative article primed and EMI shielded in accordance with the present invention. More specifically, a substrate of thermoset or thermoplastic polymeric material 100 may form part of a housing or other enclosure for electrical or electronic equipment. The interior surface of the polymeric substrate receives a prime coat 102 in accordance with steps 10–16 of FIG. 1. The prime coat 102 is shown schematically to have a relatively coarse microscopic surface area to enhance adhesion of an applied metallic film 104. The metallic film 104 may be applied according to either of the processes outlined in connection with step 18 of FIG. 1.

The invention has been described in an illustrative embodiment and terms used herein are intended to be by way of description and not limitation. The invention may be practiced within variation from the foregoing description without departing from the scope of the following claims.

The embodiments of the invention in which an exclusive property or privilege is claimed are defined as follows:

1. A method of producing an electromagnetic interference shield on a plastic substrate comprising the steps of:

a. priming the surface of the substrate by applying an organic-based coating containing a dispersion of silica gel; and b. applying a metallic film onto the primed surface.

2. The method of claim 1 wherein step b. comprises spraying the metallic film onto the surface.

3. The method of claim 2 wherein the metallic film is sprayed by an arc spraying process.

4. The method of claim 1 wherein the substrate is primed by spraying the mixture onto the surface.

5. The method of claim 1 wherein the substrate surface is primed to a thickness in the range of 1–5 mils.

6. The method of claim 1 further including a preparatory step of agitating the mixture to uniformly disperse the silica gel throughout the organic-based coating.

7. The method of claim 1 further including a preparatory step of adding a catalyst to the mixture to promote curing of the organic-based coating when applied to the substrate.

8. The method of claim 7 wherein the catalyst is an isocyanate.

9. The method of claim 1 wherein step a. includes the sub-step of curing the applied mixture prior to application of the metallic film.

10. The method of claim 9 wherein the curing sub-step is performed by air drying at ambient for approximately one half hour.

11. The method of claim 9 wherein the curing sub-step is performed by subjecting the substrate to 120°–160° F. for 15–20 minutes.

12. The method of claim 1 wherein the mixture contains 2–10% silica gel by weight.

13. The method of claim 1 wherein the metallic film is applied by electroless plating.

14. An article for shielding electromagnetic interference made in accordance with claims 1, 2, 3, 4, 5, 6, 7, 8, 9, 10, 11, 12 or 13.

15. A composite article for shielding emission of electromagnetic interference comprising:

a plastic substrate;

a primer applied to the substrate and comprising a mixture of an organic-based coating with a dispersion of silica gel; and a metallic film applied to the substrate.

16. The composite article of claim 15 wherein the metallic film is of zinc.

17. The composite article of claim 15 wherein the metallic film is of copper.

18. The composite article of claim 15 wherein the mixture contains 2–10% silica gel by weight.

19. The composite article of claim 15 wherein the mixture further comprises a catalyst to promote curing of the organic based coating.

20. The composite article of claim 15 wherein the catalyst is a urethane.

21. The composite article of claim 15 wherein the primer is applied to a thickness of 1–5 mils.

22. The composite article of claim 15 wherein the silica gel has an average particle size of about 20 microns.

* * * * *